US007992844B2

(12) United States Patent
Chiorazzi

(10) Patent No.: US 7,992,844 B2
(45) Date of Patent: Aug. 9, 2011

(54) VENTURI APPARATUS

(75) Inventor: Frank Chiorazzi, Salinas, CA (US)

(73) Assignee: Frank Chiorazzi, Salinas, CA (US)

( * ) Notice: Subject to any disclaimer, the term of this patent is extended or adjusted under 35 U.S.C. 154(b) by 821 days.

(21) Appl. No.: 12/045,361

(22) Filed: Mar. 10, 2008

(65) Prior Publication Data

US 2009/0160072 A1 Jun. 25, 2009

Related U.S. Application Data

(60) Provisional application No. 61/016,346, filed on Dec. 21, 2007.

(51) Int. Cl.
*B01F 3/04* (2006.01)

(52) U.S. Cl. ..... 261/76; 261/DIG. 75; 222/190

(58) Field of Classification Search ..... 261/76, 261/78.2, DIG. 75; 222/190
See application file for complete search history.

(56) References Cited

U.S. PATENT DOCUMENTS 3,822,217 A 7/1974 Rogers
4,224,158 A 9/1980 Molvar
4,308,138 A 12/1981 Woltman
4,522,151 A 6/1985 Arbisi et al.
5,298,198 A 3/1994 LaCrosse
5,370,069 A 12/1994 Monroe
5,514,267 A 5/1996 Machiya et al.
5,645,223 A * 7/1997 Hull et al. ..... 239/428.5
6,279,598 B1 8/2001 Boticki et al.
6,293,294 B1 9/2001 Loeb et al.
6,395,175 B1 5/2002 Gao et al.
7,156,377 B2 1/2007 Chapman et al.
7,299,743 B2 11/2007 Moore
7,614,614 B2 * 11/2009 Sabadicci et al. ..... 261/76
2004/0036185 A1 2/2004 Garcia
2004/0113288 A1 6/2004 Korzeniowski
2007/0187848 A1 8/2007 Sabadicci et al.
2007/0196249 A1 8/2007 Fridman et al.
2007/0256568 A1 11/2007 Nudi et al.

* cited by examiner

*Primary Examiner* — Robert A Hopkins
(74) *Attorney, Agent, or Firm* — LaRiviere, Grubman & Payne, LLP

(57) ABSTRACT

An improved venturi apparatus for the incorporation of air into a liquid. The preferred embodiment of the invention comprises a funnel section, a cylindrical section, and a frusto-conical section. Lateral tubes extend from the cylindrical section so as to form an acute angle relative to the central axis of the cylindrical section, thereby preventing leakage of liquid out through the lateral tubes during use and subsequent handling.

11 Claims, 4 Drawing Sheets

VENTURI APPARATUS

CROSS-REFERENCE TO RELATED DOCUMENTS

This non-provisional application is based on and claims priority to U.S. Provisional Application Ser. No. 61/016,346, filed Dec. 21, 2007.

BACKGROUND OF THE INVENTION

The principles of a venturi apparatus are well known in the art. Fluid flowing in a tube that passes through a constricted region experiences both an increase in velocity and simultaneous drop in pressure. The placement of an opening along the area of constriction produces a suction effect due to the decreased pressure of the fluid flowing in that portion of the tube. This principle has been exploited for numerous applications, including flow measurement and the introduction of additional fluids into an existing stream.

As recognized in the prior art, a simple venturi apparatus may be employed to facilitate aeration of a liquid such as wine. One such prior art design consists of a vertically oriented venturi device having a first funnel section connected to a cylindrical section that is in turn connected to a second funnel-type frusto-conical section. Two sidearm passageways extend horizontally from the cylindrical section. Liquid poured into the first funnel section is channeled into the cylindrical section, where it increases in velocity and decreases in pressure. This creates a suction effect that draws in air through the sidearm passageways. The air is thus incorporated into the liquid, which exits the device through the second funnel-type frusto-conical section. (See U.S. Patent Application Publication No. US 2007/0187848 A1).

However, problems exist in the prior art design. Notably, the device is prone to leaking liquid out through the sidearm passageways. This is especially likely to occur when a large amount of liquid is poured through the device. Furthermore, even if no leakage occurs during actual usage of the device, liquid may remain in the sidearm passageways and eventually leak out as one subsequently handles the device. In order to minimize the likelihood of leakage, a user must maintain the prior art device in a perfectly vertical orientation during usage, which requires considerable skill. And even so, this may not ensure that leakage does not occur, especially when larger quantities of liquid are poured.

The prior art device is thus unpredictably prone to leakage of liquid, which can cause many additional problems for the user. A leaked beverage such as red wine can result in stains that are difficult to clean. Such leakage also renders the device itself slippery and difficult to handle, in addition to soiling the user's hand. Moreover, beverages such as fine wine can be quite expensive, and any loss due to leakage constitutes a cost that must be borne by the user.

The prior art device is also prone to formation of a vortex in the liquid. Vortical flow causes the liquid to flow along the walls of the cylindrical section and thereby tends to block the movement of air into the liquid. This blockage thereby reduces the efficiency with which the device can aerate a liquid.

SUMMARY OF THE INVENTION

The present invention is directed to an improved vertically oriented venturi apparatus that addresses the aforementioned deficiencies in the prior art. In an embodiment of the present invention, the apparatus comprises a conduit through which a first fluid flows, having a constricted intermediate region. One or more lateral tubes for introducing a second fluid at the constricted intermediate region are formed at a substantially acute angle relative to the direction of flow of the first fluid through the constricted intermediate region.

In a preferred embodiment of the invention, the apparatus comprises a funnel section that is fluidly connected to a cylindrical section, which in turn is fluidly connected to a frusto-conical section. A vertically planar segment lies across the upper portion of the cylindrical section to inhibit vortical flow. Two diametrically opposed lateral tubes extend from the cylindrical section at a substantially acute angle relative to the central axis of the cylindrical section, and are fluidly continuous with the exterior. The lateral tubes facilitate the introduction of air into liquid flowing in the device, and their angled orientation prevents leakage of liquid through the tubes.

BEST MODES FOR CARRYING OUT THE INVENTION

The present invention is drawn to an improved venturi apparatus for mixing two fluids. In an embodiment of the present invention, the apparatus comprises a conduit through which a first fluid flows, the conduit having a constricted intermediate region. One or more lateral tubes for introducing a second fluid at the constricted intermediate region are formed at a substantially acute angle relative to the direction of flow of the first fluid through the constricted intermediate region. The constricted intermediate region has a further constriction at its downstream end, this being found to enhance mixing of the fluids. A planar segment is coupled to the intermediate region to inhibit vortical flow. A reduction in vortical flow improves the efficiency of the device because vortical flow causes fluid to adhere to the walls of the device, and thereby inhibits introduction and mixing of the second fluid.

Figure 1:
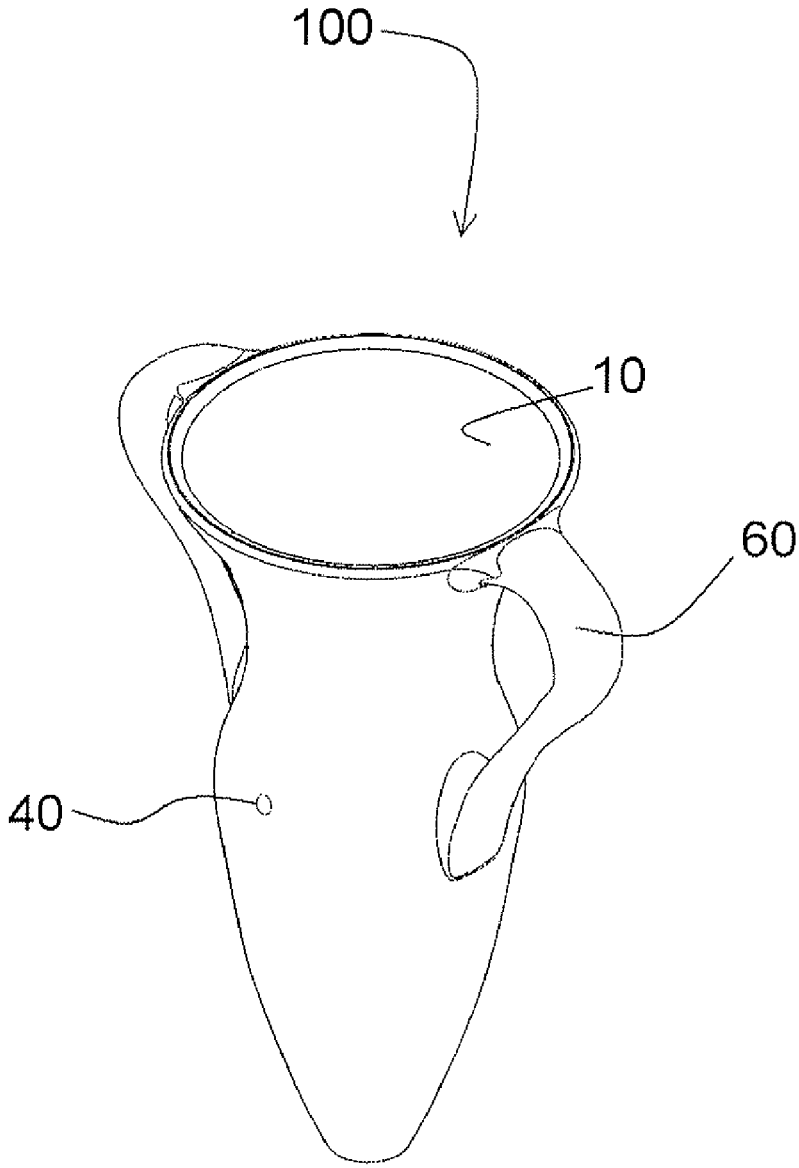
FIG. 1 is a perspective view of an embodiment of the present invention.
Figure 2:
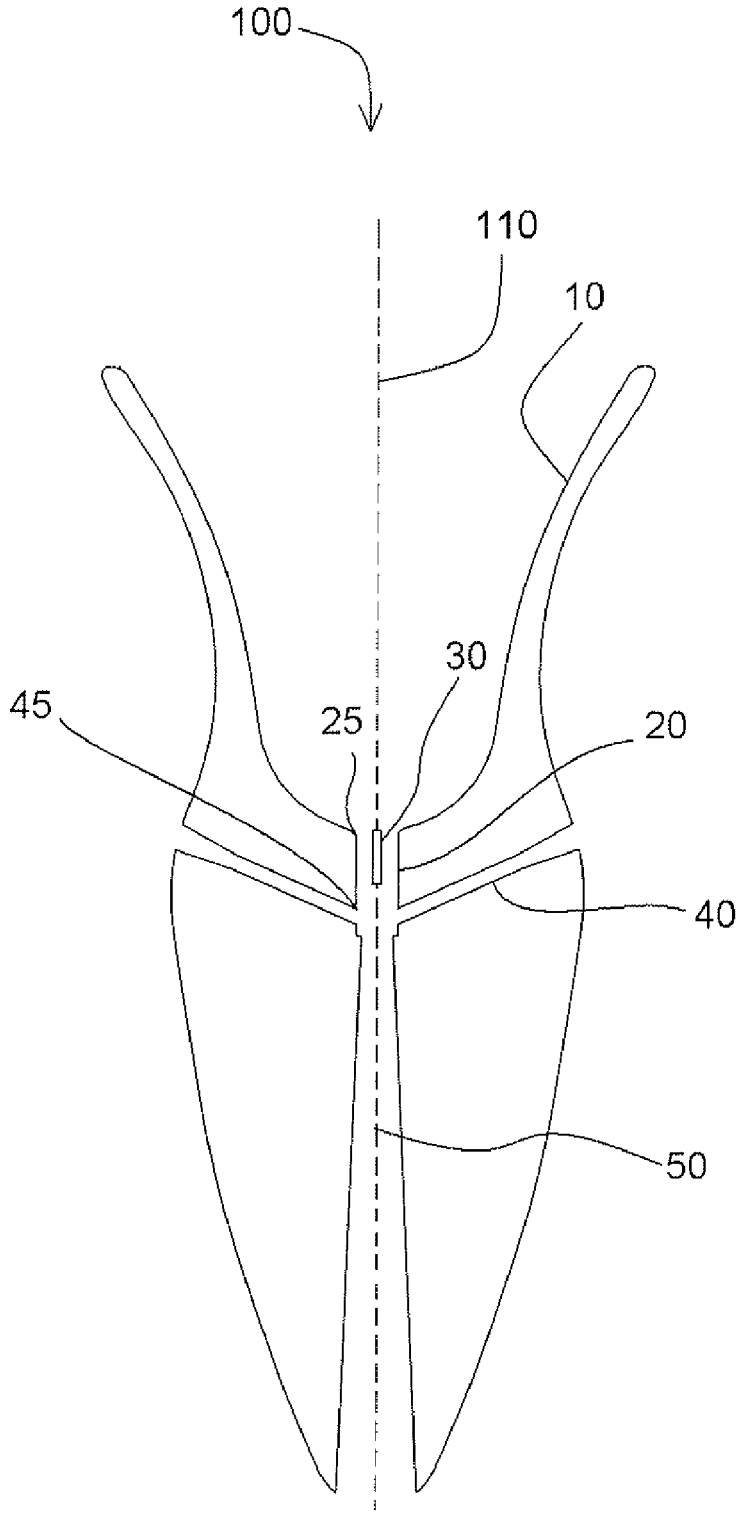
FIG. 2 is a cross section view of an embodiment of the present invention.
Figure 3:
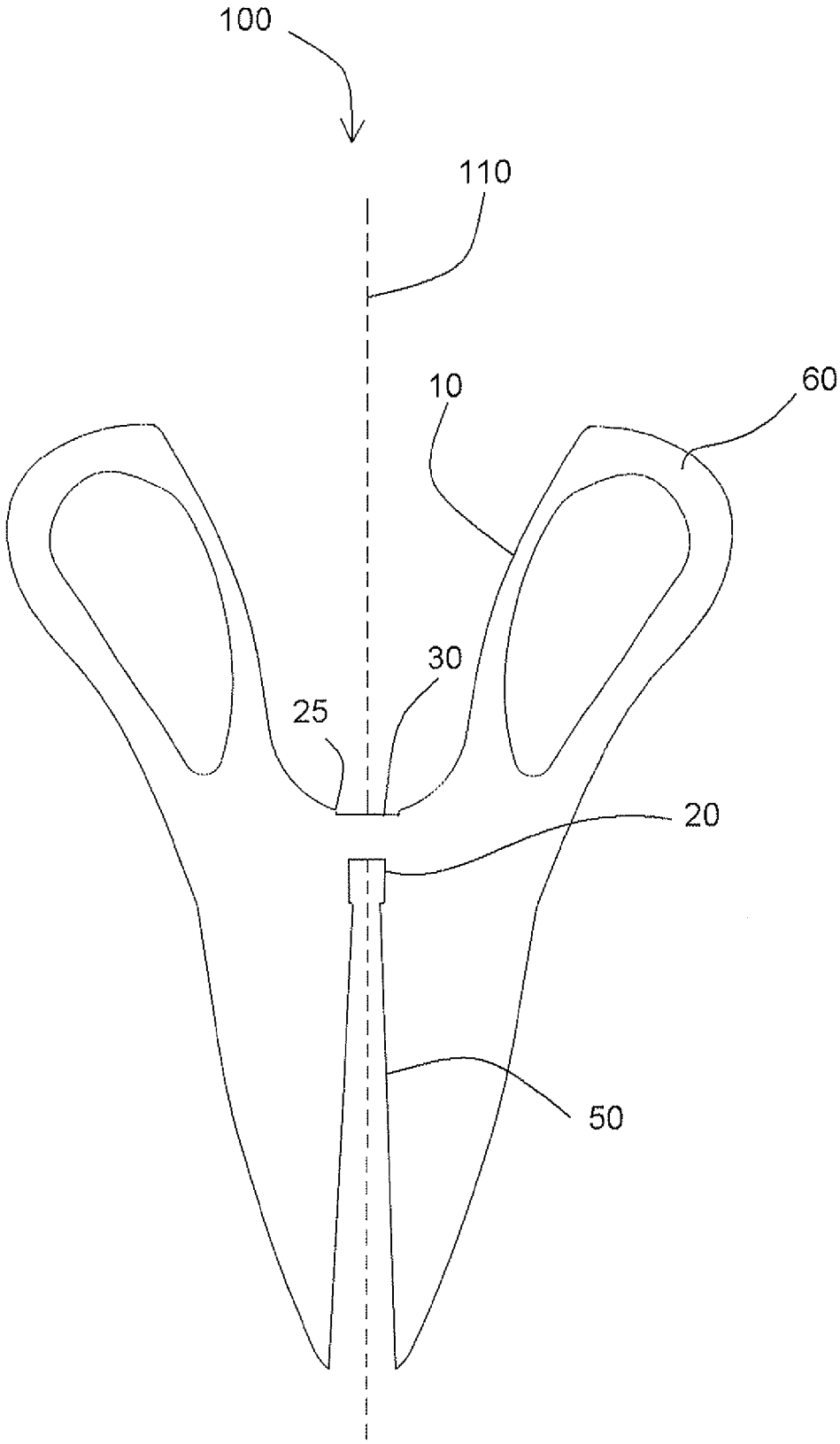
FIG. 3 is a second cross section view of an embodiment of the present invention.
Figure 4:
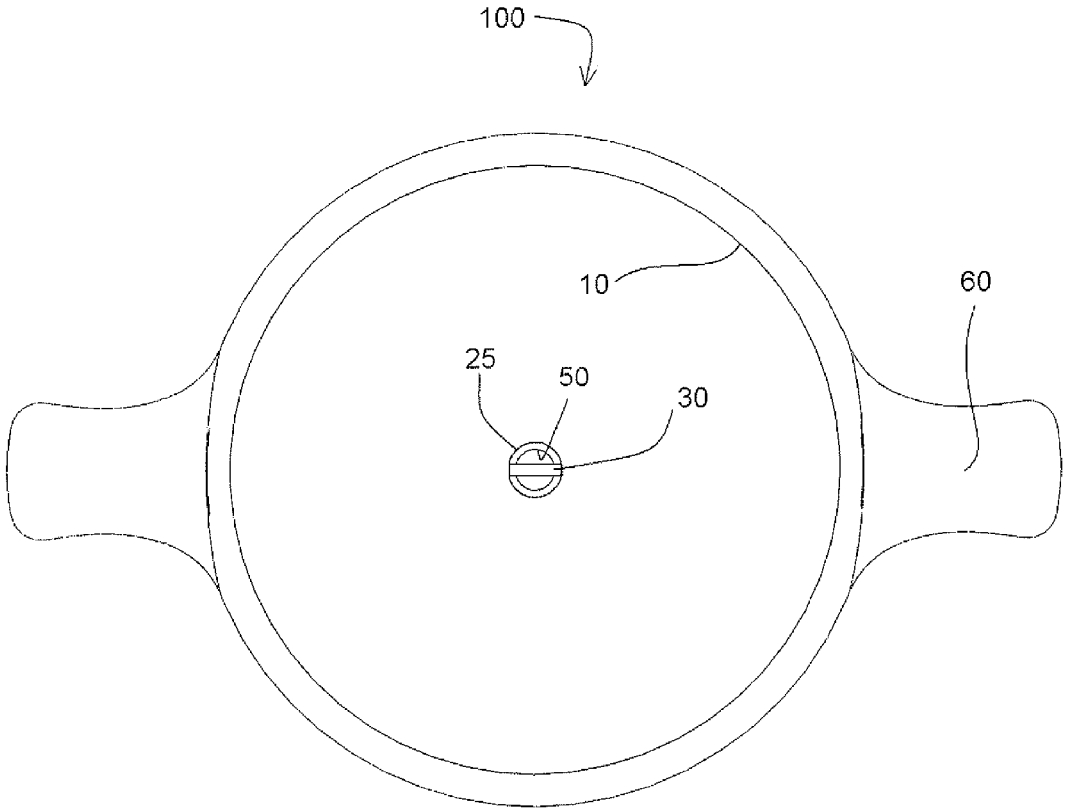
FIG. 4 is a top view of an embodiment of the present invention.

The present invention is drawn to an improved vertically oriented venturi apparatus for facilitating the aeration of a liquid beverage such as wine. With reference to FIGS. 1-4, an embodiment 100 of the present invention is shown, having a central axis 110.

Funnel section 10 has an inverted bell shape, with a flared wide end that helps prevent spillage when pouring liquid into the device. Handles 60 on opposite sides of the device provide an easy grip for holding the device and also facilitate transfer of the device from one person to another.

Cylindrical section 20 is fluidly connected at its upper end to the narrow end of funnel section 10, and centered about central axis 110. Cylindrical section 20 is preferably of substantially uniform diameter throughout its length. Rim 25 is formed by the intersection of the narrow end of funnel section 10 and the top of cylindrical section 20. The bottom of funnel section 10 is preferably bowl-shaped or substantially flat, so as to form a sharp nearly perpendicular angle at rim 25, preferably in the range of 90-120 degrees. This arrangement decreases the likelihood of vortex formation as the liquid enters cylindrical section 20.

Vertically planar segment 30 bisects the upper portion of cylindrical section 20, and counteracts any vortical flow in the liquid.

Diametrically opposed lateral tubes 40 are fluidly connected to cylindrical section 20, extending from section 20 so as to form a substantially acute angle 45 relative to the central axis 110, and are fluidly continuous with the exterior of the device. As liquid is poured through the device, air is drawn into the liquid via the lateral tubes. The upward angled orientation of the lateral tubes prevents liquid from leaking out through the tubes, during both actual use and subsequent handling.

Frusto-conical section 50 is fluidly connected at its top end to the bottom of cylindrical section 20. Frusto-conical section 50 has a diameter at its narrow end that is smaller than that of cylindrical section 20, this being found to facilitate enhanced mixing of air with liquid prior to exiting the device.

In operation, liquid to be aerated is poured into funnel section 10, and thereby channeled into cylindrical section 20. Any vortex motion is inhibited by vertical planar segment 30. This is important because vortical flow will cause the liquid to adhere to the sides of cylindrical section 20 and thereby tend to inhibit the introduction of air into the liquid. As the liquid passes through cylindrical section 20, air is drawn into the liquid through the lateral tubes 40. The aerated liquid exits the device through the frusto-conical section 50.

The foregoing exemplary embodiment is described as having two diametrically opposed lateral tubes. However, it is recognized that the device is operative with one or more lateral tubes. Moreover, the lateral tubes need not be symmetrically arranged, but may be positioned in a variety of ways, as desired for aesthetic purposes or otherwise. Therefore, in alternative embodiments of the present invention (not shown), there are one or more lateral tubes, each oriented so as to form a substantially acute angle relative to the axis of the intermediate cylindrical section. The acute angles may or may not be substantially the same.

Additionally, while the preferred embodiment of the present invention is described with respect to the introduction of air into a liquid, the device may be utilized to facilitate introduction of any fluid into another fluid, the fluids being liquid or gaseous. The preferred embodiment is contemplated to function at ambient pressures; however, the device may also be operated under pressure. Moreover, it is possible to utilize the multiple lateral tubes of the present invention to introduce multiple fluids into a single fluid flowing in the device.

The device is preferably composed of a transparent plastic material such as a polycarbonate-based plastic, which yields a robust structure while allowing one to view the liquid as it is poured through the device. However, the device is readily fabricated using other materials that are known in the art, such as glass or metal.

In other alternative embodiments of the present invention (not shown), the funnel section may have any shape that serves to funnel liquid towards the intermediate cylindrical section, such as an inverted pyramid-type shape. Likewise, the frusto-conical section may be substituted for an alternative shape of generally increasing cross-sectional area from top to bottom, such as horn-shaped, tetrahedral or pyramidal.

In further embodiments of the present invention (not shown), a filter for straining out sediments or other particulates is detachably coupled to the funnel section. The filter may have any shape suitable for coupling to the funnel section, and may be coupled by any means known in the art. In one embodiment, the filter is disc-shaped and designed to rest atop the funnel section, secured by multiple tabs extending from the rim of the filter. In another embodiment, the filter is bowl-shaped and designed to rest inside the funnel section.

Information as herein shown and described in detail is fully capable of attaining the above-described object of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, in which reference to an element in the singular is not intended to mean "one and only one" unless explicitly so stated, but rather "one or more."

All structural and functional equivalents to and combinations of the elements of the above-described preferred embodiment and additional embodiments that are known to those of ordinary skill in the art are hereby expressly incorporated by reference and are intended to be encompassed by the present claims. However, it should be readily apparent to those of ordinary skill in the art that various changes and modifications in form, apparatus material, and fabrication material detail may be made without departing from the spirit and scope of the invention as set forth in the appended claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. No claim herein is to be construed under the provisions of 35 U.S.C. §112, sixth paragraph, unless the element is expressly recited using the phrase "means for."

What is claimed is:

1. A venturi apparatus for mixing two fluids, said apparatus comprising:

a conduit through which a first fluid flows, said conduit having a constricted intermediate region;

one or more lateral tubes for introducing a second fluid at an exterior opening of the constricted intermediate region, said tubes being formed at a substantially acute angle relative to the direction of flow of the first fluid through the constricted intermediate region.

2. The apparatus of claim 1, wherein the constricted intermediate region has a further constriction at its downstream end.

3. The apparatus of claim 2, further comprising a planar segment coupled to said constricted intermediate region for inhibiting vortical flow.

4. A venturi apparatus for incorporating one or more secondary fluids into a primary fluid, said apparatus having:

a first section for channeling a primary fluid;

a second section comprising a constricted tube, and having one or more lateral tubes at an exterior opening thereof for introducing one or more secondary fluids into the primary fluid, said tubes being formed at a substantially acute angle relative to the direction of flow of the primary fluid; and a third section for expelling the combined fluids.

5. The apparatus of claim 4, wherein the downstream end of said second section is further constricted.

6. The apparatus of claim 5, further having a planar segment coupled to said second section for inhibiting vortical flow.

7. A vertically oriented venturi apparatus for incorporating air into a fluid comprising:

a funnel section having a wide end and a narrow end;

a cylindrical section having a first and second ends said first end being fluidly coupled to the narrow end of said funnel section;

a frusto-conical section having a narrow end and a wide end, fluidly coupled at its narrow end to the second end of said cylindrical section;

one or more lateral tubes extending from said cylindrical section, so as to form a substantially acute angle relative to the central axis of said cylindrical section.

8. The apparatus of claim 7 wherein the diameter of the narrow end of said frusto-conical section is smaller than the diameter of the second end of said cylindrical section.

9. The apparatus of claim 8, further comprising a vertically planar segment coupled to the first end of said cylindrical section.

10. The apparatus of claim 9 wherein the intersection of said funnel section with said cylindrical section forms a rim having an angle of approximately 90 to 120 degrees.

11. The apparatus of claim 10, further including one or more handles coupled to said funnel section.

* * * * *

UNITED STATES PATENT AND TRADEMARK OFFICE

CERTIFICATE OF CORRECTION

PATENT NO. : 7,992,844 B2
APPLICATION NO. : 12/045361
DATED : August 9, 2011
INVENTOR(S) : Frank O. Chiorazzi It is certified that error appears in the above-identified patent and that said Letters Patent is hereby corrected as shown below:

Title Page, Item (75) Inventor:

In the Inventor name:

Please correct the name from "Frank Chiorazzi" to read --Frank O. Chiorazzi--.

Signed and Sealed this
Thirteenth Day of September, 2011

David J. Kappos

David J. Kappos
*Director of the United States Patent and Trademark Office*